US008448664B2

(12) United States Patent
Lin et al.

(10) Patent No.: US 8,448,664 B2
(45) Date of Patent: May 28, 2013

(54) FLUID CONTROL DEVICE WITH FLUID TEMPERATURE DISPLAY

(75) Inventors: Xiaofa Lin, Nan'an (CN); Xiaoshan Lin, Nan'an (CN)

(73) Assignee: Fujian Xihe Sanitary Ware Technology Co., Ltd., Nan'an (CN)

( * ) Notice: Subject to any disclaimer, the term of this patent is extended or adjusted under 35 U.S.C. 154(b) by 241 days.

(21) Appl. No.: 13/108,018

(22) Filed: May 16, 2011

(65) Prior Publication Data

US 2012/0291892 A1 Nov. 22, 2012

(51) Int. Cl.

| | |
|---|---|
| ***E03B 7/07*** | (2006.01) |
| ***F16K 37/00*** | (2006.01) |
| ***F17D 3/18*** | (2006.01) |
| ***F16K 11/065*** | (2006.01) |
| ***A47K 3/28*** | (2006.01) |

(52) U.S. Cl.
USPC ..... 137/551; 137/625.11; 137/119.05; 137/872; 137/624.27; 4/597; 4/605

(58) Field of Classification Search
USPC ..... 137/551, 625.11, 119.05, 872, 624.27, 137/119.01, 119.08; 4/597, 601, 605, 615; 239/383; 236/93 B
See application file for complete search history.

(56) References Cited

U.S. PATENT DOCUMENTS

| | | | | |
|---|---|---|---|---|
| 4,854,499 | A * | 8/1989 | Neuman | 236/93 B |
| 4,936,508 | A * | 6/1990 | Ingalz | 239/72 |
| 6,997,064 | B2 * | 2/2006 | Bird et al. | 73/861.75 |
| 7,124,452 | B1 * | 10/2006 | Bauza | 4/605 |
| 7,553,076 | B2 * | 6/2009 | An | 374/148 |
| 2003/0233885 | A1 * | 12/2003 | Bird et al. | 73/861 |
| 2009/0106891 | A1 * | 4/2009 | Klicpera | 4/605 |
| 2009/0293189 | A1 * | 12/2009 | Somerville | 4/597 |
| 2009/0308951 | A1 * | 12/2009 | Suter | 239/318 |

* cited by examiner

*Primary Examiner* — Craig Schneider
*Assistant Examiner* — Atif Chaudry

(57) ABSTRACT

A fluid control device connected to a water pipe and having a mini water turbine and electrical generator combination for generating electricity by taking advantage of the water flow. The electricity is supplied to a temperature measurement member for measuring temperature of the water flowing through the device. The temperature in the form of electrical signal is sent to an LCD panel and circuit assembly for showing so as to visually alert a person using the tap water.

2 Claims, 6 Drawing Sheets

FLUID CONTROL DEVICE WITH FLUID TEMPERATURE DISPLAY

BACKGROUND OF THE INVENTION

1. Field of the Invention

The invention relates to fluid control devices and more particularly to a fluid control device connected to an end of a water pipe in a house, the device having a mini water turbine and electrical generator combination for generating electricity which is in turn supplied to a temperature measurement member for measuring temperature of the water flowing through the device, the temperature in the form of electrical signal being sent to an LCD panel for showing so as to visually alert a person using the tap water.

2. Description of Related Art

It is typical that a person may turn the handle of a faucet to let tap water flow. Tap water is cold. Thus, there are faucets (also called taps) having one spout for hot water and the other spout for cold water commercially available. However, a heating device (e.g., tankless heater) is required to install along the water pipe for heating purpose. Also, there are faucets with color LEDs to show the temperature of the water commercially available.

Thus, it is desirable of taking energy from water flowing through the pipe and converting the energy into electricity which is used as an electrical source for measuring temperature of the water.

SUMMARY OF THE INVENTION

It is therefore one object of the invention to provide a fluid control device comprising a casing comprising a water inlet at one end and a water outlet at the other end; an LCD panel and circuit assembly on the casing; a flow path switching member disposed in the casing and spaced apart from the LCD panel and circuit assembly, the flow path switching member comprising a channel; an elongated spring depressible member having one end elastically retained in the channel, the spring depressible member comprising an enlargement and a groove at the other end; a lock member lockingly engaged with the groove; a tubing member mounted at the water inlet of the casing and comprising an externally threaded section projecting out of the water inlet of the casing; a fastening member disposed in the tubing member; a turbine runner disposed directly downstream from the fastening member to be retained by the fastening member, the turbine runner comprising a plurality of blades on an outer surface; a stator disposed in the turbine runner and retained by the fastening member; a cylindrical armature winding fastened in the stator; a disc-shaped member engaged with the armature winding; a cylindrical magnetic field winding disposed in the turbine runner, the magnetic field winding being externally of the armature winding to form a gap therebetween; a retaining ring for securing the magnetic field winding to the turbine runner and urging the disc-shaped member against the stator; a cylindrical retaining member disposed directly downstream from the tubing member and engaged therewith, the retaining member comprising two opposite sets of two ports; a temperature measurement member disposed directly downstream from the retaining member; a flow redistribution member disposed directly downstream from both the flow path switching member and the spring depressible member; and a ring-shaped externally threaded fastener threadedly secured to the water outlet of the casing to fasten the flow redistribution member; wherein the armature winding, the temperature measurement member, and the LCD panel and circuit assembly are electrically connected together; wherein water flowing from the tubing member is directed on to the blades to rotate both the turbine runner and the magnetic field winding so as to change a magnetic field radially outward from the armature winding to the magnetic field winding and generate AC in the armature winding; wherein the AC is supplied to the temperature measurement member for activation so that the temperature measurement member can measure temperature of the water flowing thereto after passing the ports of the retaining member; wherein the measured temperature of the water is analog and sent to the LCD panel and circuit assembly; wherein the AC is further supplied to the LCD panel and circuit assembly to be converted into DC; and wherein the LCD panel and circuit assembly is capable of processing the analog temperature of the water into a digital form to be shown thereon.

The above and other objects, features and advantages of the invention will become apparent from the following detailed description taken with the accompanying drawings.

DETAILED DESCRIPTION OF THE INVENTION

Figure 1:
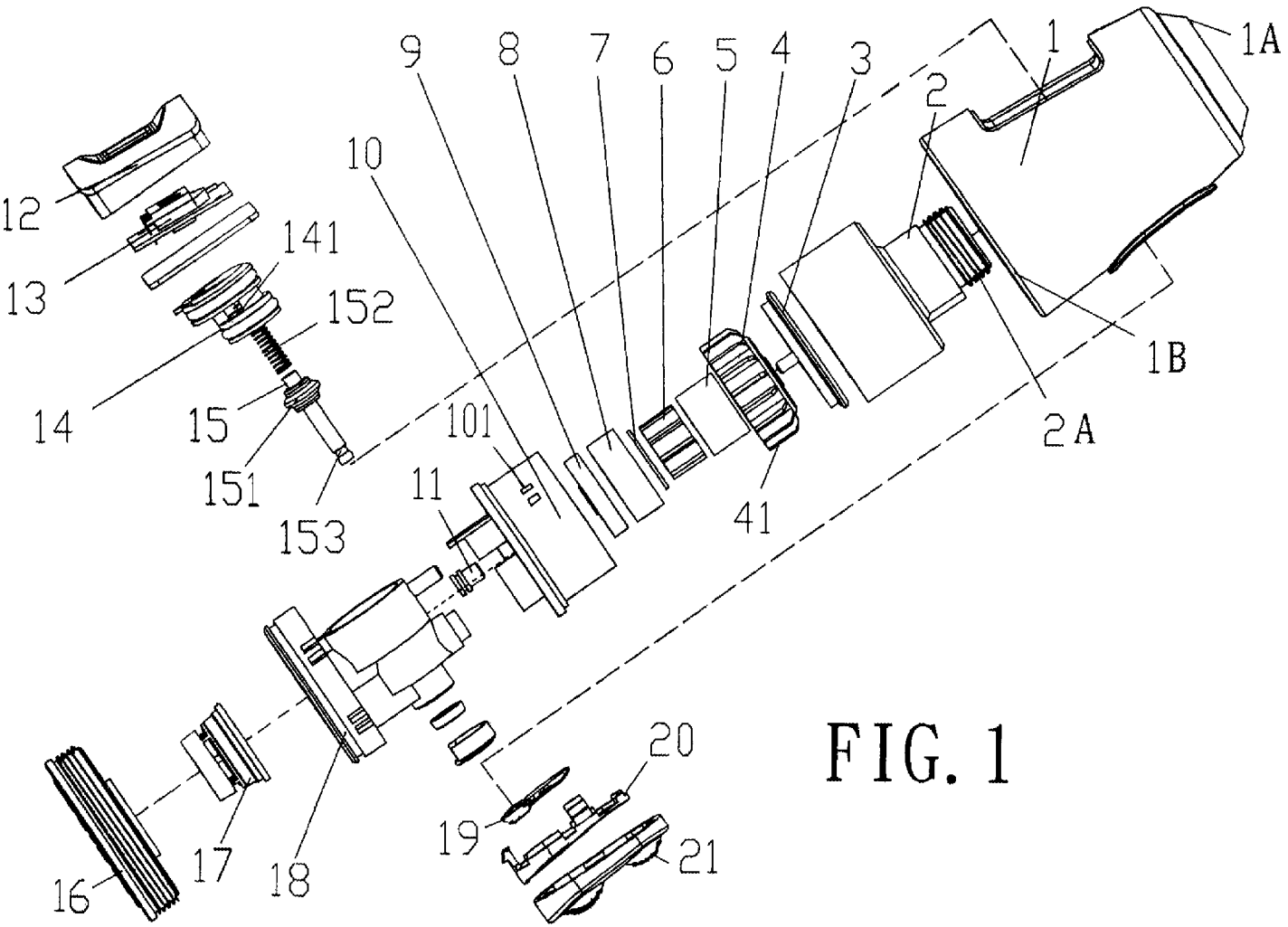
FIG. 1 is an exploded view of a fluid control device according to the invention.
Figure 2:
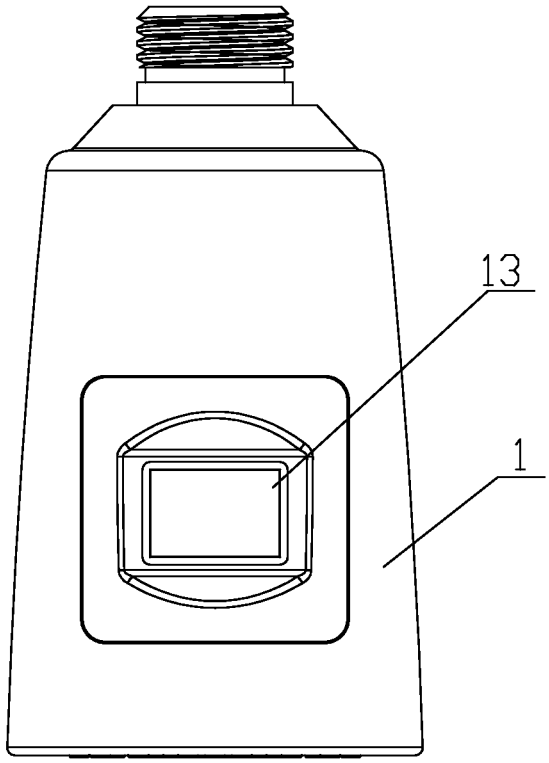
FIG. 2 is a perspective view of the assembled device.
Figure 3:
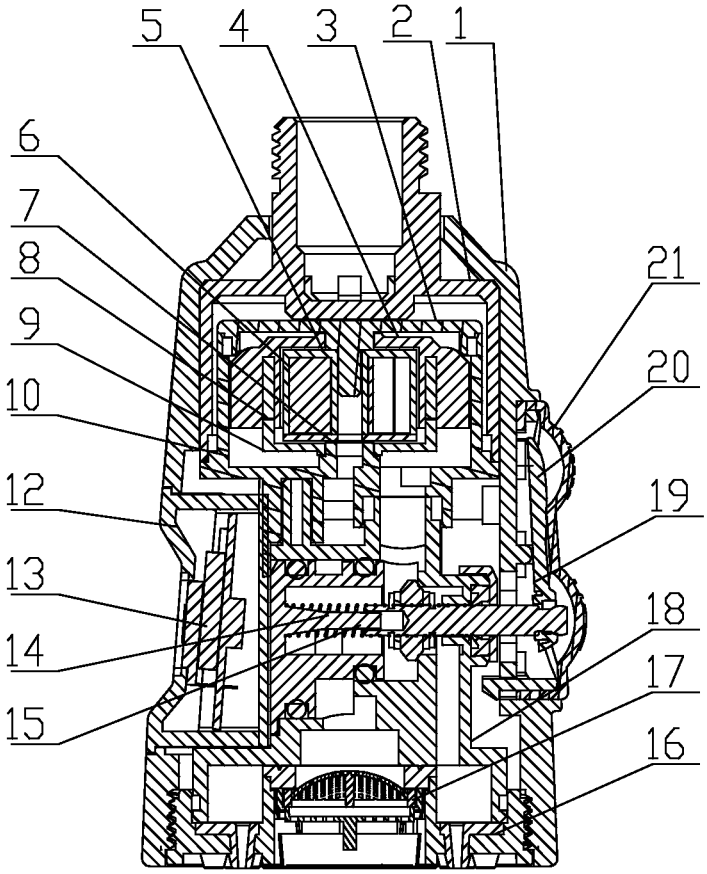
FIG. 3 is a longitudinal sectional view of the device of FIG. 2.
Figure 4:
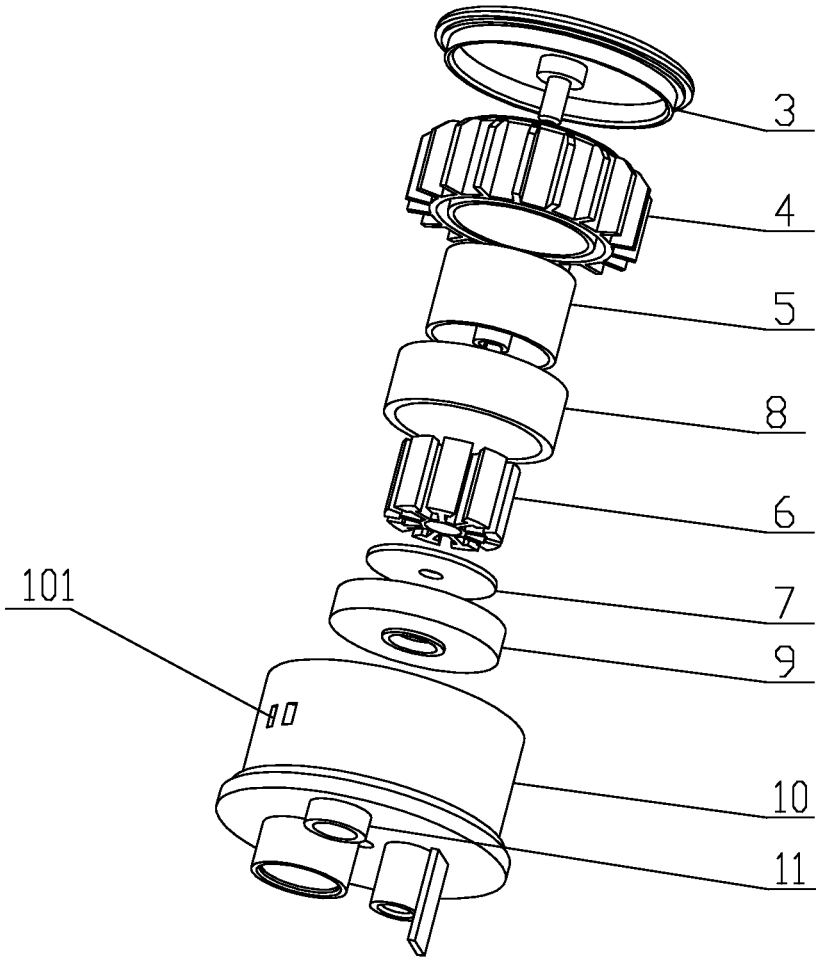
FIG. 4 is an enlarged view of the electrical generator of FIG. 1.

Referring to FIGS. 1 to 6, a fluid control device in accordance with the invention comprises the following components as discussed in detail below.

An LCD (liquid crystal display) panel and circuit assembly 13 is provided in a frame 12. The frame 12 is mounted on an outer surface of a somewhat cylindrical casing 1 having a water inlet 1A at one end and a water outlet 1B at the other end. A flow path switching member 14 is secured to the frame 12, disposed in the casing 1, and opposing and distal the LCD panel and circuit assembly 13. The flow path switching member 14 comprises a channel 141. An elongated stainless steel stem 15 comprises an enlargement 151 on an outer surface, a torsion spring 152 at one end biased between the stem 15 and a protrusion in the channel 141, and a groove 153 at the other end.

On the casing 1 at an opposite position to the above components, there are provided, from outward to inward, a rubber seal 21, a mount 20, and a lock member 19 engaged with the mount 20 and fastened by the groove 153. Above components 19, 20, 21 and 15 can be defined as a spring depressible push button.

A tubing member 2 is mounted at the water inlet 1A of the casing 1 and has an externally threaded section 2A projecting out of one end opening of the casing 1 to be secured to internal threads of an end of a water pipe mounted in, for example, a kitchen. A fastening member 3 is disposed in the casing 1 to contact an internal member of the tubing member 2. A cylindrical armature winding 6 is fastened in a stator 5 and together they are disposed in a turbine runner 4 having a plurality of blades 41 on an outer surface. The stator 5 is fastened by the fastening member 3. A disc-shaped member 7 is mounted to bottom of the armature winding 6. A cylindrical magnetic field winding 8 is disposed in the turbine runner 4 and around the armature winding 6 in a spaced fashion. A retaining ring 9 is adapted to secure the magnetic field winding 8 to the turbine runner 4 and urge the disc-shaped member 7 to seal bottom of the stator 5. A retaining member 10 comprises two opposite sets of two ports 101 on its cylindrical surface. A temperature measurement member 11 is mounted in a bottom of the retaining member 10. A flow redistribution member 18 is mounted in the casing 1 proximate to the other end of the casing 1. Two flow paths are provided by the flow redistribution member 18 as detailed later. A sieve 17 is mounted in the flow redistribution member 18. A ring-shaped externally threaded fastener 16 is threadedly secured to internal threads on an inner surface of the water outlet 1B of the casing 1 to fasten the flow redistribution member 18 in the casing 1. Thus, the flow path switching member 14 and the stem 15 are fastened by the flow redistribution member 18. The armature winding 6, the temperature measurement member 11, and the LCD panel and circuit assembly 13 are electrically connected together.

Operation of the invention will be described in detailed below. An individual may open a valve of a pipe so that water may flow from the pipe into the tubing member 2. Next, flowing water is directed on to the blades 41 of the turbine runner 4 to create a force on the blades 41. The force acts through a distance (force acting through a distance is the definition of work). In this way, energy is transferred from the water flow to the turbine runner 4 to spin same. Also, the magnetic field winding 8 spins because it is secured to the turbine runner 4. A magnetic field radially outward from the armature winding 6 to the magnetic field winding 8 (i.e., magnetic flux) is thus changed. This in turn generates AC (alternating current) in the armature winding 6. The AC current is supplied to the temperature measurement member 11 for activation so that the temperature measurement member 11 can measure temperature of the water flowing thereto after passing the ports 101 of the retaining member 10. The measured temperature of the water is in turn sent to the LCD panel and circuit assembly 13. Moreover, the AC current is supplied to the LCD panel and circuit assembly 13. A full wave rectifier of the LCD panel and circuit assembly 13 can convert AC into DC (direct current) which can be used by the LCD panel and circuit assembly 13 to process the analog temperature value into a digital form to be shown thereon.

Figure 5:
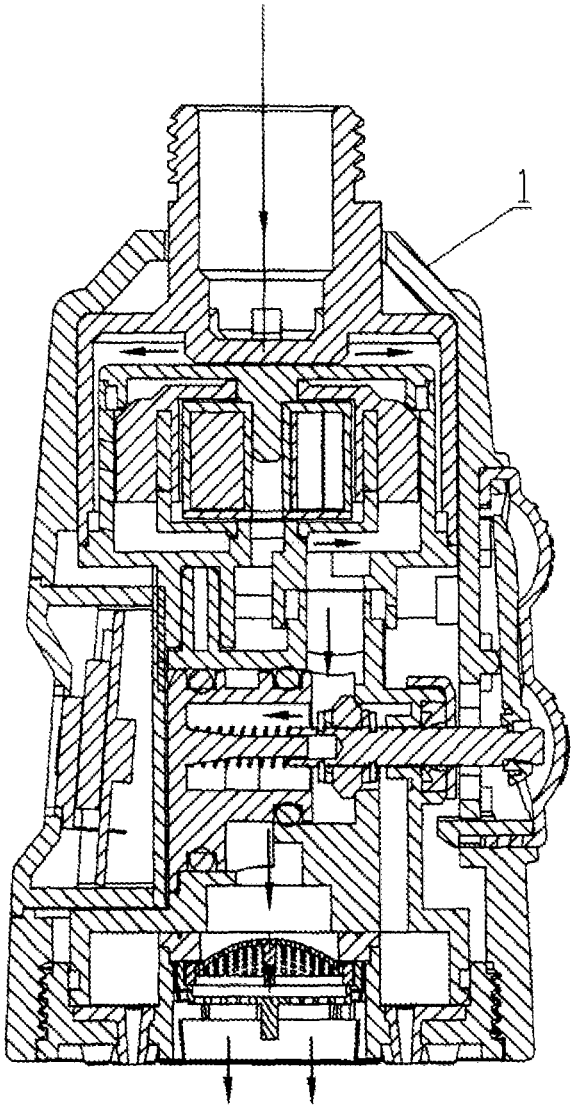
FIG. 5 is a view similar to FIG. 3 showing a first flow path of the device.

As shown in FIG. 5, in a first (default) flow path of the device the stem 15 is locked at a first position (i.e., the lock member 19 tightly engaged with the groove 153) by the lock member 19. After passing the temperature measurement member 11 the water may continue to flow through the channel 141 of the flow path switching member 14, an inner chamber of the flow redistribution member 18, and the sieve 17 prior to leaving the device.

Figure 6:
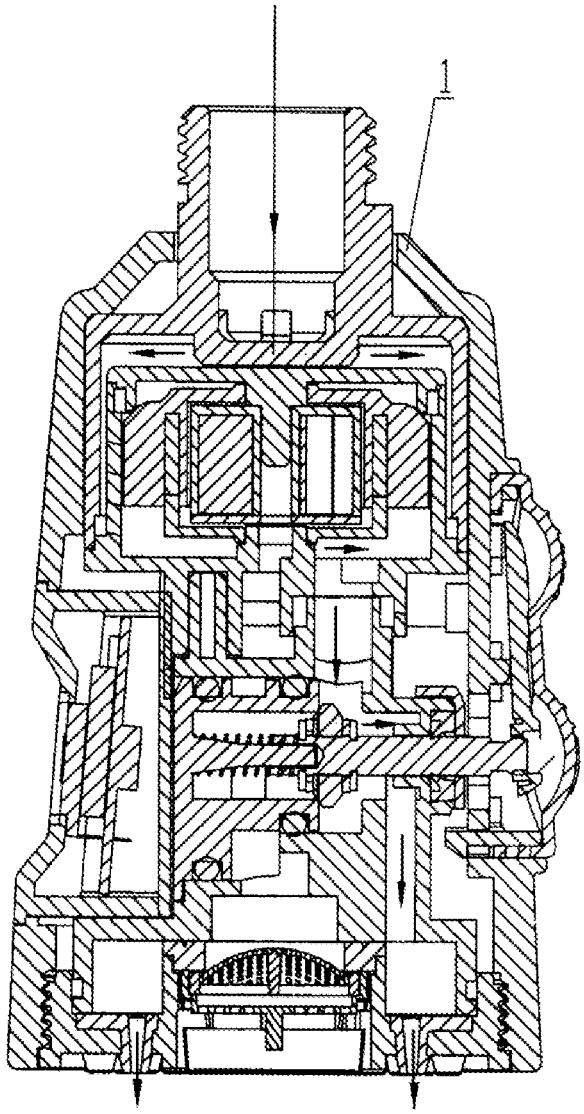
FIG. 6 is a view similar to FIG. 3 showing a second flow path the device after pressing the push button.

Moreover, as shown in FIG. 6, individual may press the rubber seal 21 to lock the stem 15 at a second position of the lock member 19 (i.e., disengaged from the groove 153) with the channel 141 being blocked by the enlargement 151. Thus, after passing the temperature measurement member 11 the water flow may bypass the flow path switching member 14 to flow through an outer annular tunnel of the stem 15 and also bypass the sieve 17 prior to leaving the device.

While the invention has been described in terms of preferred embodiments, those skilled in the art will recognize that the invention can be practiced with modifications within the spirit and scope of the appended claims.

What is claimed is:

1. A fluid control device comprising:

a casing (1) comprising a water inlet (1A) at one end and a water outlet (1B) at the other end;

an LCD panel and circuit assembly (13) on the casing (1);

a flow path switching member (14) disposed in the casing (1) and spaced apart from the LCD panel and circuit assembly (13), the flow path switching member (14) comprising a channel (141);

an elongated spring depressible member (15) having one end elastically retained in the channel (141), the spring depressible member (15) comprising an enlargement (151) and a groove (153) at the other end;

a lock member (19) lockingly engaged with the groove (153) in a first flow path position, the lock member (19) disposed on the casing (1) opposing the LCD panel and circuit assembly (13);

a tubing member (2) mounted at the water inlet (1A) of the casing (1) and comprising an externally threaded section (2A) projecting out of the water inlet (1A) of the casing (1);

a fastening member (3) disposed in the tubing member (2);

a turbine runner (4) disposed directly downstream from the fastening member (3) to be retained by the fastening member (3), the turbine runner (4) comprising a plurality of blades (41) on an outer surface;

a stator (5) disposed in the turbine runner (4) and retained by the fastening member (3);

a cylindrical armature winding (6) fastened in the stator (5);

a disc-shaped member (7) engaged with the armature winding (6);

a cylindrical magnetic field winding (8) disposed in the turbine runner (4), the magnetic field winding (8) being externally of the armature winding (6) to form a gap therebetween;

a retaining ring (9) for securing the magnetic field winding (8) to the turbine runner (4) and urging the disc-shaped member (7) against the stator (5);

a cylindrical retaining member (10) disposed directly downstream from the tubing member (2) and engaged therewith, the retaining member (10) comprising two opposite sets of two ports (101);

a temperature measurement member (11) disposed directly downstream from the retaining member (10);

a flow redistribution member (18) disposed directly downstream from both the flow path switching member (14) and the spring depressible member (15); and a ring-shaped externally threaded fastener (16) threadedly secured to the water outlet (1B) of the casing (1) to fasten the flow redistribution member (18);

wherein the channel (141) is not blocked by the enlargement (151) in the first flow path position;

wherein the armature winding (6), the temperature measurement member (11), and the LCD panel and circuit assembly (13) are electrically connected together;

wherein water flowing from the tubing member (2) is directed on to the blades (41) to rotate both the turbine runner (4) and the magnetic field winding (8) so as to change a magnetic field radially outward from the armature winding (6) to the magnetic field winding (8) and generate AC in the armature winding (6);

wherein the AC is supplied to the temperature measurement member (11) for activation so that the temperature measurement member (11) can measure temperature of the water flowing thereto after passing the ports (101) of the retaining member (10);

wherein the measured temperature of the water is analog and sent to the LCD panel and circuit assembly (13);

wherein the AC is further supplied to the LCD panel and circuit assembly (13) to be converted into DC; and wherein the LCD panel and circuit assembly (13) is capable of processing the analog temperature of the water into a digital form to be shown thereon.

2. The fluid control device of claim 1, wherein a pressing of the spring depressible member (15) can disengage the lock member (19) from the groove (153), cause the enlargement (151) to block the channel (141), and lockingly engage the lock member (19) with the spring depressible member (15) in a second flow path position.

* * * * *